US006290525B1

(12) United States Patent
Jacobi

(10) Patent No.: US 6,290,525 B1
(45) Date of Patent: Sep. 18, 2001

(54) PLUG CONNECTOR WITH AXIAL LOCKING FUNCTION AGAINST SEPARATION

(75) Inventor: Wolfgang Jacobi, München (DE)

(73) Assignee: Otto Dunkel GmbH Fabrik für elektrotechnische Geräte, Mühldorf (DE)

( * ) Notice: Subject to any disclaimer, the term of this patent is extended or adjusted under 35 U.S.C. 154(b) by 0 days.

(21) Appl. No.: 09/550,347

(22) Filed: Apr. 14, 2000

(30) Foreign Application Priority Data

Apr. 19, 1999 (DE) ..... 199 17 549

(51) Int. Cl.[7] ..... H01R 13/62
(52) U.S. Cl. ..... 439/319; 439/310
(58) Field of Search ..... 439/314, 307, 439/311, 312, 313, 328, 350, 351, 352, 353, 91, 31, 310; 285/319; 287/119

(56) References Cited

U.S. PATENT DOCUMENTS

| | | | | |
|---|---|---|---|---|
| 3,639,890 | | 2/1972 | Stevens et al. . | |
| 4,531,801 | * | 7/1985 | Baur | 439/89 |
| 4,927,374 | * | 5/1990 | Batty | 439/310 |
| 5,447,447 | * | 9/1995 | Guss, III et al. | 439/321 |
| 5,620,339 | * | 4/1997 | Gray et al. | 439/578 |
| 5,810,615 | * | 9/1998 | Ohta | 439/313 |
| 6,083,030 | * | 7/2000 | Wright | 439/352 |

OTHER PUBLICATIONS

Odu–Mini–Snap, Miniature Cylindrical Connectors with Push–Pull–Locking, p. 4, No. 8S.

* cited by examiner

*Primary Examiner*—Tulsidas Patel
(74) *Attorney, Agent, or Firm*—Friedrich Kueffner

(57) ABSTRACT

A plug connector has a male plug part, connected to an electric connecting cable and having contact elements, and a female plug part with matching counter contact elements providing electric contact in a contact position established when the male plug part is inserted into the female plug part. The female plug part has a sleeve-shaped housing having an inner circumferential surface with a locking edge. The male plug part has a locking sleeve and an outer sleeve axially slipped onto the locking sleeve. The outer sleeve has locking tabs engaging the locking edge in the contact position. The locking sleeve has several tongue-shaped thickened portions distributed circumferentially that have radially outwardly positioned cone-shaped locking surfaces. The locking tabs are spaced circumferentially from one another by a spacing that allows the thickened portions to pass between the locking tabs when the outer sleeve is slipped onto the locking sleeve. The outer sleeve is rotatable about an angle of half the angular spacing between the locking tabs so as to axially align the locking tabs and the thickened portions. The locking surfaces act on the locking tabs when the locking sleeve is axially loaded in a direction counter to the assembly direction to prevent the plug connector from separating.

7 Claims, 2 Drawing Sheets

FIG. 1
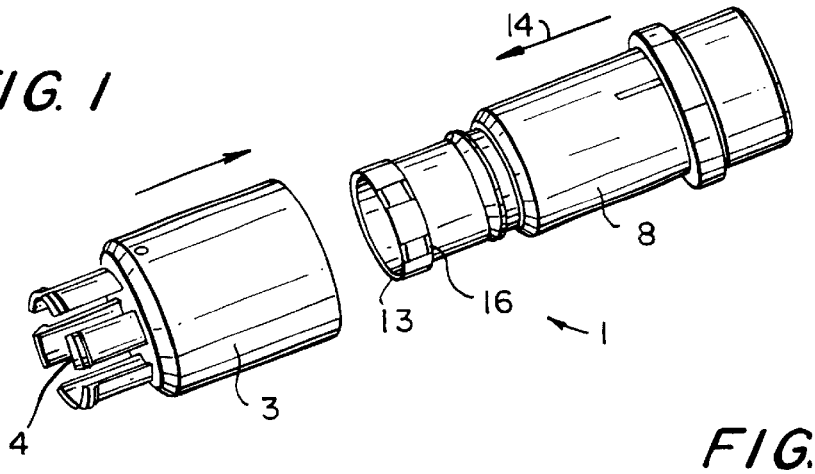
FIG. 2
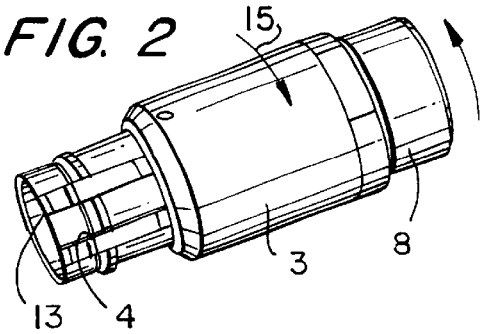
FIG. 3
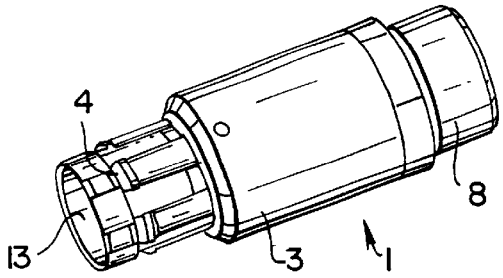
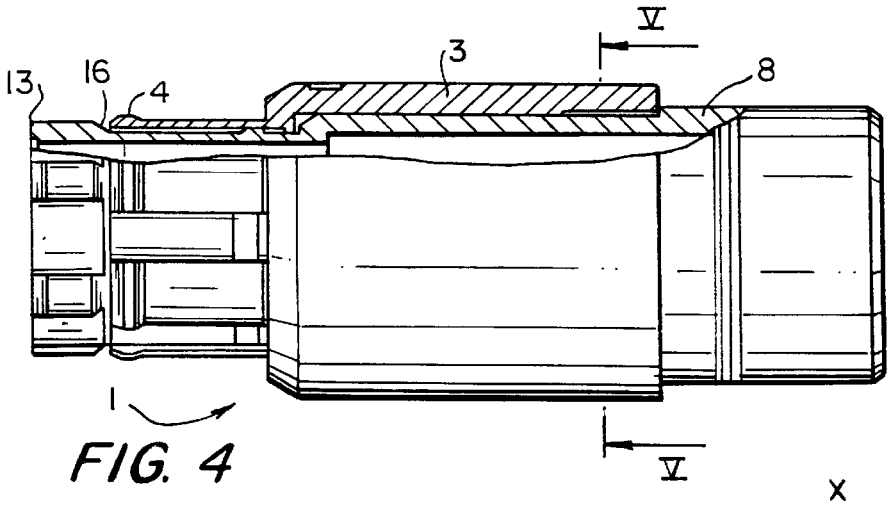
FIG. 4
FIG. 5
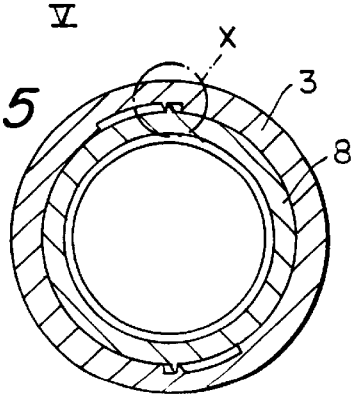
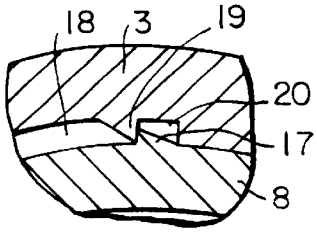
FIG. 6

PLUG CONNECTOR WITH AXIAL LOCKING FUNCTION AGAINST SEPARATION

BACKGROUND OF THE INVENTION

1. Field of the Invention

The invention relates to an electrical plug connector with a substantially sleeve-shaped male plug part having electrical contacts of a connecting cable arranged therein and with a female plug part in which the sleeve-shaped male plug part is received. The female plug connector is preferably a plug part incorporated into an electric device. The female plug part comprises electrical counter contacts matching the electrical contacts of the male plug part. It also has at its inner circumferential surface a locking edge which is engaged by locking tabs of an outer sleeve of the male plug part in the connected state of the plug connector. The locking tabs engaging the locking edge prevent a separation of the plug connector as long as the locking tabs are subjected to radial forces of cone-shaped locking surfaces of a locking sleeve supported within the outer sleeve. These forces result when the locking sleeve moves axially relative to the outer sleeve as a result of an axial loading of the connecting cable.

2. Description of the Related Art

In a known plug connector of this kind, as illustrated in FIGS. 7 through 10 of the drawing, the sleeve-shaped male plug connector 1 has electrical contacts (not shown in detail) provided on a connecting cable 2. At its outer side the male plug part 1 has an axially movable outer sleeve 3 with locking tabs 4 at its end face. As shown schematically in FIG. 8, the male plug part 1 can be inserted into the female plug part 5 having electrical counter contacts (not shown in detail in the drawing). The female plug part is preferably embodied as a component of an electric device. The female plug part 5 has a machined groove 6, and one of the limiting edges of the groove 6 acts as a locking edge 7 for the locking tabs 4 of the outer sleeve 3 of the plug part 1 inserted into the female plug part 5.

Especially FIG. 9 shows that the male plug part 1 has coordinated therewith a locking sleeve 8 positioned within the outer sleeve 3 and enclosing the connecting cable 2. The locking sleeve 8 comprises a conical sleeve portion 9. When the connecting cable 2 is axially loaded in the direction of arrow 10, the locking sleeve 8 with the conical sleeve portion 9 is entrained in the axial direction so that a radial force is exerted onto the locking tabs 4 by the conical sleeve portion 9 which consequently prevents a separation of the plug connector parts 1, 5 in the area of the locking edge 7 of the groove 6, indicated by the large arrow 11. Only when, as illustrated in FIG. 10, the cable 2 and thus the conical sleeve 9 remain axially free of a load, is it possible to realize a radial deflection of the locking tabs 4 in the area of the locking edge 7 by axially loading only the outer sleeve 3 according to arrow 12. The plug connector can be opened, i.e., the male plug part can be disconnected, in this way.

This known embodiment requires a separate manufacture of the locking sleeve 8 with conical sleeve portion 9, and the sleeve (8, 9) must be mounted in a cumbersome way from the front end of the plug part 1 on the other plug part components and must be secured thereat.

SUMMARY OF THE INVENTION

It is an object of the present invention to further develop a plug connector of the aforementioned kind such that a simple configuration and an easier assembly are provided.

In accordance with the present invention, this is achieved in that the locking sleeve has several tongue-shaped thickened portions, distributed about the circumference of the sleeve and having at their outer side a respective cone-shaped locking surface, that the locking tabs of the outer sleeve are spaced from one another in the circumferential direction by a spacing which allows the tongue-shaped thickened portions of the locking sleeve to pass axially therethrough, and that the locking sleeve can be rotated relative to the outer sleeve by an angular range which corresponds to half the angular spacing of the locking tabs.

Such a plug connector makes it possible to insert the locking sleeve with its cone-shaped locking surface formed by the tongue-shaped thickened portions from the rear through the outer sleeve, wherein the tongue-shaped thickened portions pass between the locking tabs, and to then rotate the two sleeves relative to one another such that the tongue-shaped thickened portions will come to rest beneath the locking tabs.

It is, of course, possible to manufacture the locking sleeve and/or the outer sleeve of metal. However, it is especially favorable to produce the locking sleeve and/or the outer sleeve of synthetic (plastic) material. These parts can thus be produced very economically by injection molding.

In a very beneficial further embodiment of the plug connector, the outer sleeve and the locking sleeve are provided with a rotational securing device comprised of rotational securing elements, formed unitarily on the plug parts, for limiting the rotational angle between the locking sleeve and the outer sleeve.

Moreover, it should be mentioned that in an especially expedient embodiment the locking edge of the female plug part is realized by a limiting edge of a machined or molded groove.

BRIEF DESCRIPTION OF THE DRAWING

In the drawing:

FIG. 1 is a perspective view of the male plug part of the inventive plug connector before insertion of the locking sleeve into the outer sleeve;

FIG. 2 is a perspective view of the male plug part of the plug connector according to the invention after insertion of the locking sleeve into the outer sleeve, but before rotation of both sleeves relative to one another;

FIG. 3 is a perspective view according to that of FIG. 2 after relative rotation of the sleeves;

FIG. 4 is a longitudinal sectional view of the plug part according to FIG. 3;

FIG. 5 is a cross-sectional view of the plug part taken along the line V—V of FIG. 4;

FIG. 6 is an enlarged view of the detail X of FIG. 5; and

DESCRIPTION OF THE PREFERRED EMBODIMENTS

Figure 7:
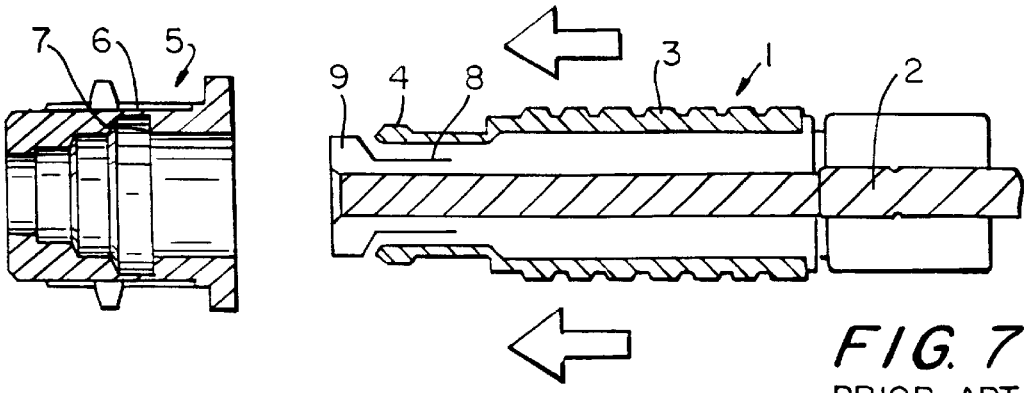
FIG. 7 PRIOR ART
FIGS. 7 through 10 show respectively longitudinal sectional views for illustrating the configuration and function of a prior art plug connector.
Figure 8:
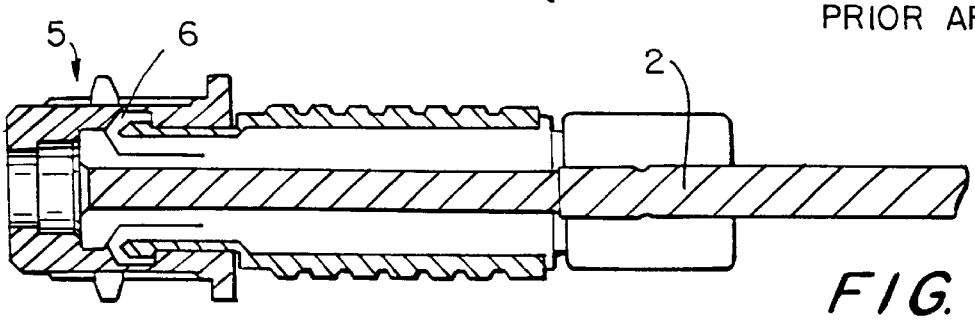
FIG. 8 PRIOR ART
Figure 9:
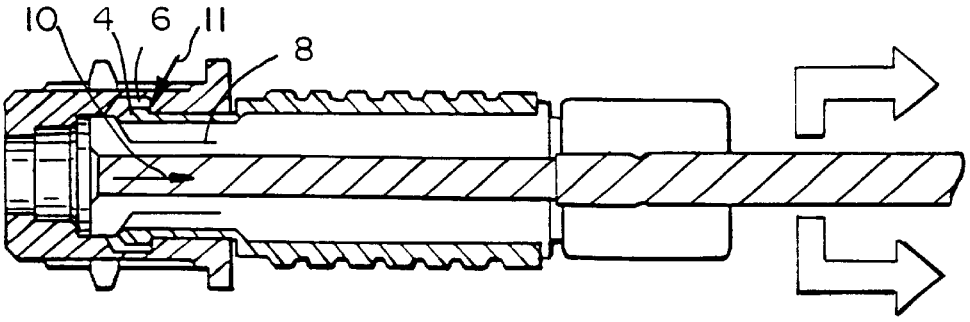
FIG. 9 PRIOR ART
Figure 10:
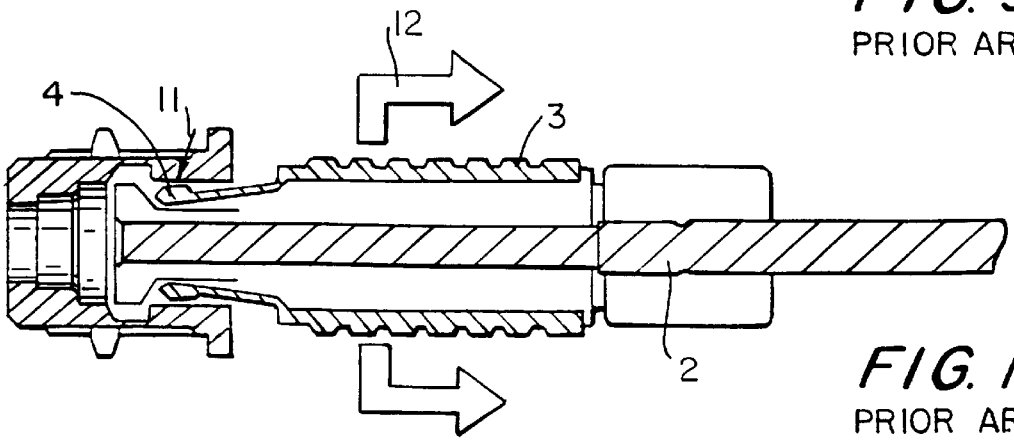
FIG. 10 PRIOR ART

As can be seen in FIG. 1, the sleeve-shaped male plug part 1 comprises several tongue-shaped thickened portions 13 which are monolithic components of the locking sleeve 8 and practically take over the function of the known cone sleeve (element 9 in FIGS. 7 through 10). The tongue-shaped thickened portions 13 are uniformly distributed about the locking sleeve circumference. At their outer side these thickened portions 13 have a respective locking surface 16 that is shaped as a portion of an envelope of a cone. In the following, this configuration is simply referred to as cone-shape.

The locking tabs 4 of the outer sleeve 3, as illustrated in the drawing, have in the circumferential direction a spacing relative to one another which allows the axial passage of the tongue-shaped thickened portions 13 of the locking sleeve 8 between the tabs 4 in the direction of arrow 14. Subsequently, the locking sleeve 8, as indicated by arrow 15 in FIG. 2, can be rotated relative to the outer sleeve 3 by an angular range, which corresponds to half the angular spacing between the locking tabs 4, into the position illustrated in FIGS. 3 and 4. Finally, the cone-shaped locking surfaces 16 of the tongue-shaped thickened portions 13 are aligned with the locking tabs 4.

In this inserted position, a rotational securing device is provided at the outer sleeve 3 and the locking sleeve 8 for the purpose of securing the two sleeves in their matched relative position. For this purpose, the outer side of the locking sleeve 8 has a first rotational securing element in the form of a projecting tooth 17 which upon tangential relative rotation of the two sleeves 3, 8 glides within a groove 18 provided at the inner surface of the sleeve 3 until it contacts a second rotational securing element in the form of a counter tooth 19 at the inner side of the sleeve 3. Upon overcoming the resistance presented by this counter tooth 19, the tooth 17 will snap into place in the securing recess 20 and thus secure the properly aligned position of the thickened portions 13 and the locking tabs 4.

When a pulling action on the electrical cable (not shown) axially loads the locking sleeve 8 with the tongue-shaped thickened portions 13, each having a respective locking surface 16 in the form of a portion of a cone envelope, the locking tabs 4 of the outer sleeve 3 will be spread apart in the radially outward direction and secured in the groove (6) with locking edge (7), as described supra in regard to the prior art. Accordingly, the same locking or securing principle as explained supra in connection with the so-called push-pull-plugs of the prior art is ensured. However, the configuration of the present invention has the advantage that the locking sleeve 8, together with the tongue-shaped thickened portions 13 and their cone-shaped locking surfaces 16 distributed about the sleeve circumference, is realized as a monolithic component so that no separate mounting step is required.

Between the connecting locations of the locking tabs 4 at the end face of the outer sleeve 3, radial recesses (not shown) are provided which have a depth which is at least of the thickness of the tongue-shaped thickened portions 13 for forming the cone-shaped locking surfaces 16 to thus allow axial passage of the locking sleeve 8 through the outer sleeve 3.

While specific embodiments of the invention have been shown and described in detail to illustrate the inventive principles, it will be understood that the invention may be embodied otherwise without departing from such principles.

What is claimed is:

1. A plug connector comprising:

a sleeve-shaped male plug part configured to be connected to an electric connecting cable and having contact elements;

a matching female plug part having matching counter contact elements configured to provide electric contact with the contact elements in a contact position established when the male plug part is inserted into the female plug part;

the female plug part having a sleeve-shaped housing having an inner circumferential surface with a locking edge;

the male plug part comprising a locking sleeve and an outer sleeve configured to be axially slipped onto the locking sleeve in an assembly direction and rotatably seated radially outwardly on the locking sleeve;

the outer sleeve having several locking tabs configured to engage the locking edge in the contact position;

the locking sleeve having several tongue-shaped thickened portions distributed circumferentially about the locking sleeve;

the tongue-shaped thickened portions having radially outwardly positioned locking surfaces shaped as a portion of a cone envelope;

the locking tabs being spaced circumferentially from one another by an angular spacing so as to allow the tongue-shaped thickened portions to pass between the locking tabs when the outer sleeve is slipped onto the locking sleeve;

the outer sleeve being rotatable about a rotational angle of one half of the angular spacing between the locking tabs so as to align the locking tabs and the tongue-shaped thickened portions with one another in the axial direction, wherein the locking surfaces are configured to act on the locking tabs when an axial load acts on the locking sleeve in a direction counter to the assembly direction in order to prevent the male plug part and the female plug part from separating in the contact position.

2. The plug connector according to claim 1, wherein the locking sleeve is made of a synthetic material.

3. The plug connector according to claim 1, wherein the outer sleeve is made of a synthetic material.

4. The plug connector according to claim 1, wherein the locking sleeve and the outer sleeve are made of a synthetic material.

5. The plug connector according to claim 1, wherein the outer sleeve has a first rotational securing element and the locking sleeve has a second rotational counter securing element configured to cooperate with the first rotational securing element in order to limit the rotational angle of the outer sleeve.

6. The plug connector according to claim 1, wherein the inner circumferential surface of the female plug part has a circumferential groove and wherein the locking edge is a limiting edge of the circumferential groove.

7. The plug connector according to claim 1, wherein the female plug part is a part of an electrical device.

* * * * *